US009076444B2

(12) United States Patent
Lee

(10) Patent No.: US 9,076,444 B2
(45) Date of Patent: Jul. 7, 2015

(54) METHOD AND APPARATUS FOR SINUSOIDAL AUDIO CODING AND METHOD AND APPARATUS FOR SINUSOIDAL AUDIO DECODING

(75) Inventor: Nam-suk Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1389 days.

(21) Appl. No.: 12/030,275

(22) Filed: Feb. 13, 2008

(65) Prior Publication Data

US 2008/0305752 A1 Dec. 11, 2008

(30) Foreign Application Priority Data

Jun. 7, 2007 (KR) ..... 10-2007-0055717

(51) Int. Cl.
*G10L 19/12* (2013.01)
*G10L 19/093* (2013.01)

(52) U.S. Cl.
CPC ..... *G10L 19/093* (2013.01)

(58) Field of Classification Search
CPC ..... G10L 19/093
USPC ..... 704/500–504, 205, 206
See application file for complete search history.

(56) References Cited

U.S. PATENT DOCUMENTS 5,054,072 A * 10/1991 McAulay et al. ..... 704/207
5,179,626 A * 1/1993 Thomson ..... 704/200
6,266,644 B1 * 7/2001 Levine ..... 704/503
6,571,207 B1 * 5/2003 Kim ..... 704/200
6,687,667 B1 2/2004 Gournay et al.
6,915,256 B2 7/2005 Ramabadran et al.
7,197,454 B2 * 3/2007 Van Der Kerkhof et al. . 704/219
7,260,541 B2 * 8/2007 Tsushima et al. ..... 704/500
7,599,840 B2 * 10/2009 Mehrotra et al. ..... 704/501
2001/0032087 A1 * 10/2001 Oomen et al. ..... 704/500
2002/0154774 A1 10/2002 Oomen et al.
2003/0083886 A1 * 5/2003 Den Brinker et al. ..... 704/500

(Continued)

FOREIGN PATENT DOCUMENTS

KR 20030010702 A 2/2003
KR 1020040055788 A 6/2004

(Continued)

OTHER PUBLICATIONS

Brinker et al. "Parametric Coding for High-Quality Audio", Audio Engineering Society paper, Presented at the 112th Convention, May 2002.*

(Continued)

*Primary Examiner* — Jialong He
(74) *Attorney, Agent, or Firm* — Sughrue Mion, PLLC

(57) ABSTRACT

A method and apparatus for sinusoidal audio coding and decoding are provided. The method for sinusoidal audio coding includes performing sinusoidal analysis on an input signal and extracting sinusoids of a current frame; tracking and coding a continuation mode sinusoid of the current frame by using a sinusoid of a previous frame which continues to the continuation mode sinusoid; searching for a sinusoid having a closest frequency to a frequency of a birth mode sinusoid of the current frame; calculating and coding a difference between an amplitude of the sinusoid having the closest frequency and an amplitude of the birth mode sinusoid; and coding the frequency of the birth mode sinusoid.

21 Claims, 9 Drawing Sheets

(56) References Cited

U.S. PATENT DOCUMENTS

| | | | | |
|---|---|---|---|---|
| 2004/0204936 | A1* | 10/2004 | Jensen et al. | 704/230 |
| 2007/0112560 | A1* | 5/2007 | Gerrits et al. | 704/205 |

FOREIGN PATENT DOCUMENTS

| | | | |
|---|---|---|---|
| KR | 10-2005-0058262 | A | 6/2005 |
| KR | 10-2006-0083202 | A | 7/2006 |

OTHER PUBLICATIONS

Quatieri et al. "Speech Transformations Based on a Sinusoidal Representation,", IEEE Trans. on Acoustics, Speech and Signal Processing, vol. ASSP-34, Dec. 1986.*

Moon et al. "A Multi-Channel Audio Compression Method with Virtual Source Location Information for MPEG-4 SAC" IEEE Transactions on Consumer Electronics, 2005, p. 1253-1256, vol. 51, No. 4.

* cited by examiner

FIG. 9

| Test Sequence | Coding Gain of Amplitude of Birth Mode Sinusoid (%) | Coding Gain of Birth Mode Sinusoid (%) | Coding Gain of Entire Bit Rate (%) |
|---|---|---|---|
| Bass | 25.92 | 7.21 | 4.13 |
| Brahms | 18.89 | 5.18 | 2.19 |
| Dongwoo | 9.68 | 2.47 | 1.36 |
| Dust | 14.89 | 3.95 | 1.89 |
| Harp | 13.78 | 3.60 | 1.40 |
| Horn | 20.62 | 5.80 | 2.56 |
| Hotel | 13.26 | 3.41 | 1.76 |
| Trilogy | 10.09 | 2.62 | 1.31 |
| Average Coding Gain (%) | 15.89 | 4.28 | 2.11 |

METHOD AND APPARATUS FOR SINUSOIDAL AUDIO CODING AND METHOD AND APPARATUS FOR SINUSOIDAL AUDIO DECODING

CROSS-REFERENCE TO RELATED PATENT APPLICATION

This application claims priority from Korean Patent Application No. 10-2007-0055717, filed on Jun. 7, 2007, in the Korean Intellectual Property Office, the disclosure of which is incorporated herein in its entirety by reference.

BACKGROUND OF THE INVENTION

1. Field of the Invention

Methods and apparatuses consistent with the present invention relate to coding and decoding of an audio signal, and more particularly, to efficient coding and decoding of birth mode sinusoids.

2. Description of the Related Art

Parametric coding is a method of coding an audio signal according to certain parameters. The parametric coding is used for Moving Picture Experts Group-4 (MPEG-4) standards.

FIG. 1 is a diagram for describing a related art parametric coding method. The parametric coding method analyzes and parameterizes an input audio signal.

Referring to FIG. 1, audio reading and filtering are performed on the input audio signal. Transient analysis, sinusoidal analysis, and noise analysis are performed on each region of the input audio signal, thereby extracting parameters of audio components of each region. The transient analysis corresponds to very dynamic audio variations. The sinusoidal analysis corresponds to deterministic audio variations. The noise analysis corresponds to stochastic or non-deterministic audio variations.

Bit-stream formatting is performed on the extracted parameters.

After performing the sinusoidal analysis, extracted sinusoids are tracked for adaptive differential pulse code modulation (ADPCM) coding or differential pulse code modulation (DPCM) coding. The tracking searches for sinusoids of a current frame which are continued from sinusoids of a previous frame and set correspondence therebetween. Sinusoids of the current frame which can be tracked from the sinusoids of the previous frame are referred to as continuation mode sinusoids. The continuation mode sinusoids may be efficiently coded by using the sinusoids of the previous frame which correspond to the continuation mode sinusoids.

On the other hand, sinusoids of the current frame which are not tracked from the sinusoids of the previous frame are referred to as birth mode sinusoids. The birth mode sinusoids are newly generated in the current frame instead of being continued from the sinusoids of the previous frame. In general, the birth mode sinusoids cannot be coded by using the sinusoids of the previous frame and thus a large number of bits are required for coding.

Accordingly, a method of reducing the number of bits is required to code the birth mode sinusoids.

FIG. 2 is a flowchart of a related art audio coding method.

Referring to FIG. 2, sinusoidal analysis is performed on an input audio signal and sinusoids, also referred to as partials, are extracted. The extracted sinusoids are tracked by using information on the sinusoids in operation S100. The tracking searches for sinusoids of a current frame which are continued from sinusoids of a previous frame and set correspondence therebetween. During the tracking of the sinusoids, continuation mode sinusoids are coded.

Birth mode sinusoids from among the sinusoids of the current frame are sorted in ascending order of frequency in operation S110. Here, the number of birth mode sinusoids is assumed to be n.

The birth mode sinusoids are input one by one in order of frequency from a birth mode sinusoid having a lower frequency to a birth mode sinusoid having a higher frequency in order to perform following operations in operation S120. Here, a frequency and an amplitude of a birth mode sinusoid are respectively represented as f(i) and a(i).

1. The amplitude a(i) is quantized in operation S130. The quantized amplitude is represented as q_a(i).

2. It is determined whether the birth mode sinusoid has the lowest frequency or not in operation S140. If it is determined that the birth mode sinusoid has the lowest frequency, the quantized amplitude q_a(i) is absolutely coded in operations S150 and S170.

3. If it is determined that the birth mode sinusoid does not have the lowest frequency, a difference between the quantized amplitude q_a(i) of the current birth mode sinusoid and a quantized amplitude q_a(i-1) of a previous birth mode sinusoid is calculated in operation S160, and the difference is coded in operation S170.

FIG. 3 is a graph of an example to which the audio coding method of FIG. 2 is applied.

Referring to FIG. 3, sinusoids of a current frame are p30, p31, p32, p33, p34, p35, and p36 and continuation mode sinusoids are P31, p32, p34, and p36. The continuation mode sinusoid p31 is continued from a previous sinusoid p20, the continuation mode sinusoid p32 is continued from a previous sinusoid p21, the continuation mode sinusoid p34 is continued from a previous sinusoid p22, and the continuation mode sinusoid p36 is continued from a previous sinusoid p23.

On the other hand, birth mode sinusoids are p30, p33, and p35.

If the related art audio coding method of FIG. 2 is applied here, an amplitude a30 of the birth mode sinusoid p30 is absolutely coded. However, with regard to an amplitude a33 of the birth mode sinusoid p33, a difference diff33=a33−a30 is calculated and coded. Also, with regard to an amplitude a35 of the birth mode sinusoid p35, a difference diff35=a35−a33 is calculated and coded.

The present invention provides an efficient coding method by addressing a problem of the related art method, which is that difference coding is performed between birth mode sinusoids.

In an audio signal, sinusoids having frequencies close to each other also have similar amplitudes. Accordingly, when the difference coding is performed on an amplitude of a sinusoid, it is advantageous to calculate an amplitude difference from a sinusoid having a close frequency. However, referring back to FIG. 2, the difference coding is performed between the birth mode sinusoids so that coding efficiency is greatly reduced if a frequency difference therebetween is large. Referring back to FIG. 3, when the birth mode sinusoid p33 is coded, due to a large frequency difference between the birth mode sinusoids p30 and p33, the amplitude difference therebetween may also be large. In this case, if the amplitude difference is coded, the coded value has a large number of bits. For example, if the amplitude a33 is 3 bits and the amplitude a30 is 10 bits, the amplitude difference is larger than the amplitude a33.

Difference coding is performed because the number of bits required to code is less than when absolute coding is performed, if the amplitudes of the sinusoids have correlations therebetween. However, in the above example, absolute coding may be more efficient.

The present invention suggests an efficient method of further reducing the number of bits required to code birth mode sinusoids by using sinusoids having large correlations therebetween.

SUMMARY OF THE INVENTION

The present invention provides a method and apparatus for sinusoidal audio coding capable of efficient coding of birth mode sinusoids, and a computer readable recording medium having recorded thereon a computer program for executing the method of sinusoidal audio coding.

The present invention also provides a method and apparatus for sinusoidal audio decoding capable of efficient decoding of birth mode sinusoids, and a computer readable recording medium having recorded thereon a computer program for executing the method of sinusoidal audio decoding.

According to an aspect of the present invention, there is provided a method of sinusoidal audio coding, the method including performing sinusoidal analysis on an input signal and extracting sinusoids of a current frame; tracking and coding a continuation mode sinusoid of the current frame by using a sinusoid of a previous frame which continues to the continuation mode sinusoid; searching for a sinusoid having a closest frequency to the frequency of a birth mode sinusoid of the current frame; calculating and coding a difference between an amplitude of the sinusoid having the closest frequency and the amplitude of the birth mode sinusoid; and coding the frequency of the birth mode sinusoid.

The searching for the sinusoid having the closest frequency may include searching for the other sinusoid having the closest frequency from among sinusoids having lower frequencies than the frequency of the birth mode sinusoid.

The searching for the sinusoid having the closest frequency may include searching for the other sinusoid having the closest frequency from among previously coded sinusoids.

The calculating and coding of the difference between the amplitude of the sinusoid having the closest frequency and the amplitude of the birth mode sinusoid may include quantizing the amplitude of the sinusoid having the closest frequency; inverse quantizing the quantized amplitude; calculating a difference between the amplitude of the birth mode sinusoid and the inverse quantized amplitude; quantizing the difference; and coding the quantized difference.

According to another aspect of the present invention, there is provided an apparatus for sinusoidal audio coding, the apparatus including a sinusoidal analysis unit for performing sinusoidal analysis on an input signal and extracting sinusoids of a current frame; a sinusoid tracking unit for tracking and coding a continuation mode sinusoid of the current frame by using a sinusoid of a previous frame which continues to the continuation mode sinusoid; a birth mode amplitude coding unit for searching for a sinusoid having a closest frequency to the frequency of a birth mode sinusoid of the current frame, and calculating and coding a difference between an amplitude of the sinusoid having the closest frequency and the amplitude of the birth mode sinusoid; and a birth mode frequency coding unit for coding the frequency of the birth mode sinusoid.

The birth mode amplitude coding unit may search for the sinusoid having the closest frequency from among sinusoids having lower frequencies than the frequency of the birth mode sinusoid.

The birth mode amplitude coding unit may search for the sinusoid having the closest frequency from among previously coded sinusoids.

The birth mode amplitude coding unit may quantize the amplitude of the sinusoid having the closest frequency, inverse quantize the quantized amplitude, calculate a difference between the amplitude of the birth mode sinusoid and the inverse quantized amplitude, quantize the difference, and code the quantized difference.

According to another aspect of the present invention, there is provided a method of sinusoidal audio decoding, the method including decoding a continuation mode sinusoid from among coded sinusoids of a current frame; decoding a frequency of a birth mode sinusoid of the current frame; searching for a sinusoid having a closest frequency to the decoded frequency; decoding a coded amplitude difference of the birth mode sinusoid; and calculating an amplitude of the birth mode sinusoid by adding the amplitude of the sinusoid having the closest frequency to the decoded amplitude difference.

The searching for the sinusoid having the closest frequency may include searching for the sinusoid having the closest frequency from among sinusoids having lower frequencies than the frequency of the birth mode sinusoid.

The searching for the sinusoid having the closest frequency may include searching for the sinusoid having the closest frequency from among previously decoded sinusoids.

According to another aspect of the present invention, there is provided an apparatus for sinusoidal audio decoding, the apparatus including a continuation mode sinusoid decoding unit for decoding a continuation mode sinusoid from among coded sinusoids of a current frame; a birth mode frequency decoding unit for decoding a frequency of a birth mode sinusoid of the current frame; and a birth mode amplitude decoding unit for searching for a sinusoid having a closest frequency to the decoded frequency, decoding a coded amplitude difference of the birth mode sinusoid, and calculating an amplitude of the birth mode sinusoid by adding the amplitude of the sinusoid having the closest frequency to the decoded amplitude difference.

The birth mode amplitude decoding unit may search for the sinusoid having the closest frequency from among sinusoids having lower frequencies than the frequency of the birth mode sinusoid.

The birth mode amplitude decoding unit may search for the sinusoid having the closest frequency from among previously decoded sinusoids.

BRIEF DESCRIPTION OF THE DRAWINGS

The above and other aspects of the present invention will become more apparent by describing in detail exemplary embodiments thereof with reference to the attached drawings, in which:

FIG. 9 is a table showing coding gains obtained by a sinusoidal audio coding method according to an exemplary embodiment of the present invention in comparison to a related art sinusoidal audio coding method.

DETAILED DESCRIPTION OF EXEMPLARY EMBODIMENTS

Hereinafter, the present invention will be described in detail by explaining exemplary embodiments of the invention with reference to the attached drawings.

Figure 4:
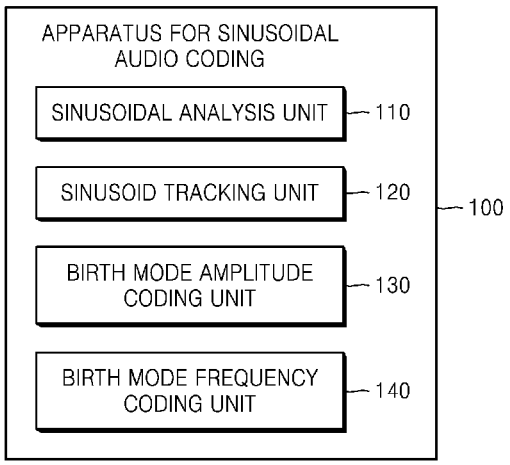
FIG. 4 is a block diagram of an apparatus for sinusoidal audio coding, according to an exemplary embodiment of the present invention.

FIG. 4 is a block diagram of an apparatus 100 for sinusoidal audio coding, according to an exemplary embodiment of the present invention.

Referring to FIG. 4, the apparatus 100 includes a sinusoidal analysis unit 110, a sinusoid tracking unit 120, a birth mode amplitude coding unit 130, and a birth mode frequency coding unit 140.

The sinusoidal analysis unit 110 performs sinusoidal analysis on an input audio signal and extracts sinusoids of a current frame.

The sinusoid tracking unit 120 tracks and codes a continuation mode sinusoid of the current frame by using a sinusoid of a previous frame which continues to the continuation mode sinusoid.

The birth mode amplitude coding unit 130 searches for a sinusoid having the closest frequency to the frequency of a birth mode sinusoid of the current frame, and calculates and codes a difference between an amplitude of the sinusoid having the closest frequency and the amplitude of the birth mode sinusoid.

The birth mode frequency coding unit 140 codes the frequency of the birth mode sinusoid.

Figure 5:
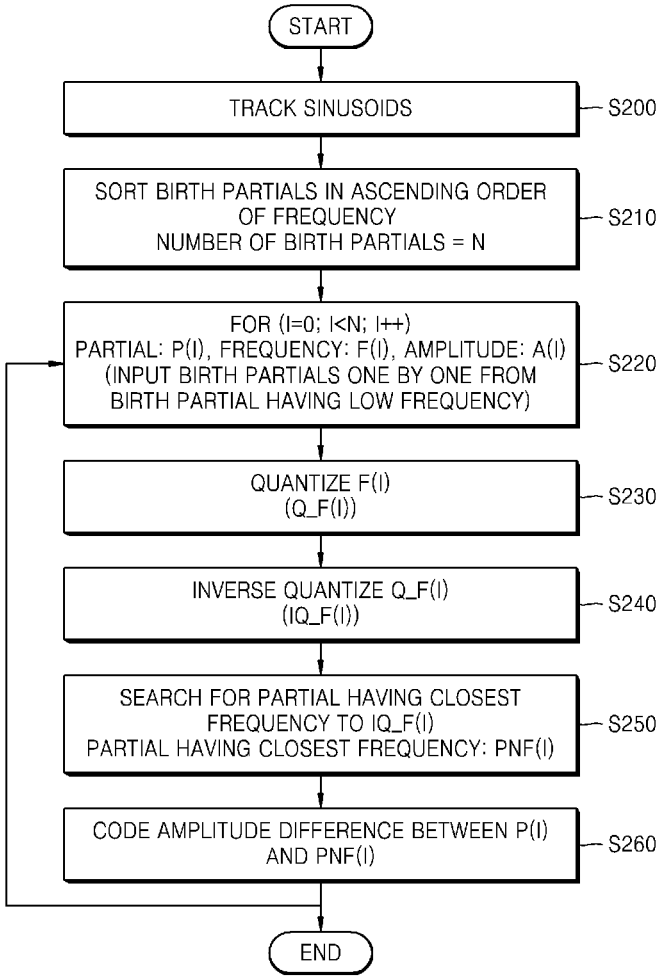
FIG. 5 is a flowchart of a sinusoidal audio coding method, according to an exemplary embodiment of the present invention.

FIG. 5 is a flowchart of a sinusoidal audio coding method, according to an exemplary embodiment of the present invention. The flowchart of FIG. 5 will be described in conjunction with FIG. 4.

Referring to FIG. 5, the sinusoidal analysis unit 110 performs sinusoidal analysis on an input signal and extracts sinusoids of a current frame (operation not shown). The sinusoids are also referred to as partials.

The sinusoid tracking unit 120 tracks and codes continuation mode sinusoids in operation S200. The tracking of the continuation mode sinusoids is performed so as to determine whether the sinusoids of the current frame continue from sinusoids of a previous frame.

Sinusoids which are not tracked from the sinusoids of the previous frame are newly generated in the current frame and are referred to as birth mode sinusoids or birth partials. The birth mode sinusoids are sorted in ascending order of frequency in operation S210. Here, the number of birth partials is assumed to be n.

The birth mode sinusoids are input one by one in order of frequency from a birth mode sinusoid having a lower frequency to a birth mode sinusoid having a higher frequency in order to perform following operations in operation S220. Here, a sinusoid, and a frequency and an amplitude of the birth mode sinusoid are respectively represented as p(i), f(i) and a(i).

1. The frequency f(i) is quantized in operation S230. The quantized frequency is represented as q_f(i).

2. The quantized frequency q_f(i) is inverse quantized in operation S240. The inverse quantized frequency is represented as iq_f(i).

3. A sinusoid having the nearest frequency to the frequency f(i) is found in operation S250. The sinusoid having the nearest frequency is represented as pnf(i).

4. A difference between the amplitude a(i) of the birth mode sinusoid p(i) to be currently coded and an amplitude b(i) of the sinusoid pnf(i) having the nearest frequency is calculated and coded in operation S260.

Operations S230 and S240 are performed in order to set frequencies the same as the frequencies to be used when decoding is performed later.

Figure 6:
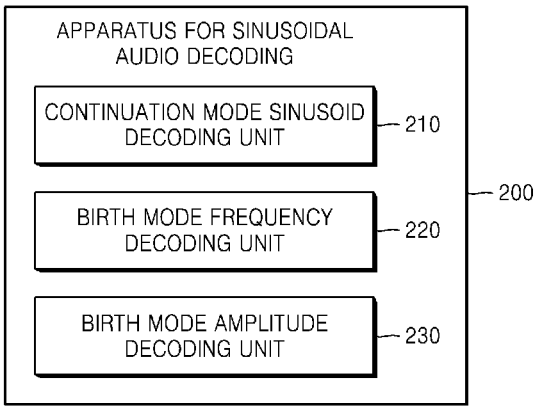
FIG. 6 is a block diagram of an apparatus for sinusoidal audio decoding, according to an exemplary embodiment of the present invention.

FIG. 6 is a block diagram of an apparatus 200 for sinusoidal audio decoding, according to an exemplary embodiment of the present invention.

Referring to FIG. 6, the apparatus 200 includes a continuation mode sinusoid decoding unit 210, a birth mode frequency decoding unit 220, and a birth mode amplitude decoding unit 230.

The continuation mode sinusoid decoding unit 210 decodes a continuation mode sinusoid from among coded sinusoids of a current frame.

The birth mode frequency decoding unit 220 decodes a frequency of a birth mode sinusoid of the current frame.

The birth mode amplitude decoding unit 230 searches for a sinusoid having the closest frequency to the decoded frequency, decodes a coded amplitude difference of the birth mode sinusoid, and calculates an amplitude of the birth mode sinusoid by adding the amplitude of the sinusoid having the closest frequency to the decoded amplitude difference.

Figure 7:
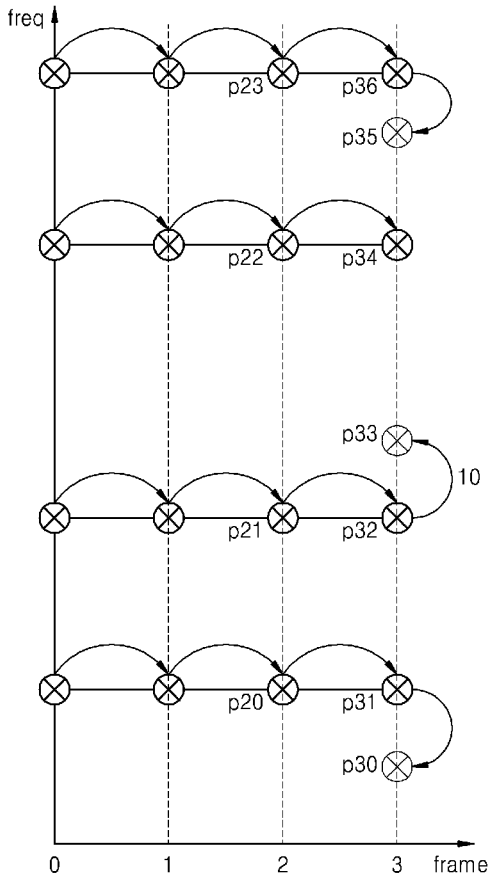
FIG. 7 is a graph of an example to which a sinusoidal audio coding method according to an exemplary embodiment of the present invention is applied.

FIG. 7 is a graph of an example to which a sinusoidal audio coding method according to an exemplary embodiment of the present invention is applied.

Referring to FIG. 7, sinusoids of a current frame are p30, p31, p32, p33, p34, p35, and p36 and continuation mode sinusoids are P31, p32, p34, and p36. The continuation mode sinusoid p31 is continued from a previous sinusoid p20, the continuation mode sinusoid p32 is continued from a previous sinusoid p21, the continuation mode sinusoid p34 is continued from a previous sinusoid p22, and the continuation mode sinusoid p36 is continued from a previous sinusoid p23.

On the other hand, birth mode sinusoids are p30, p33, and p35.

Figure 1:
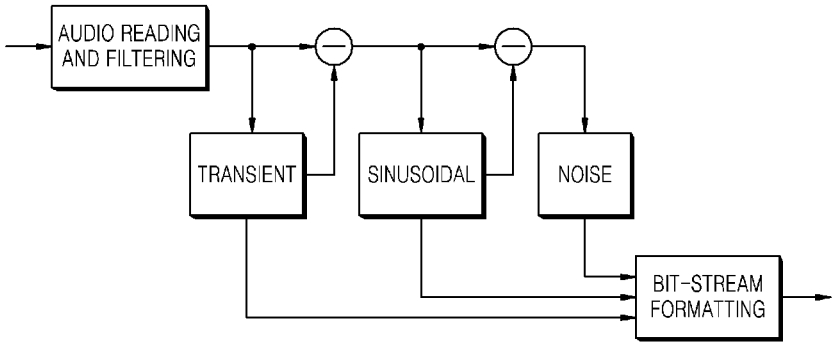
FIG. 1 (RELATED ART)
FIG. 1 is a diagram for describing a related at parametric coding method which analyzes and parameterizes an input audio signal.
Figure 2:
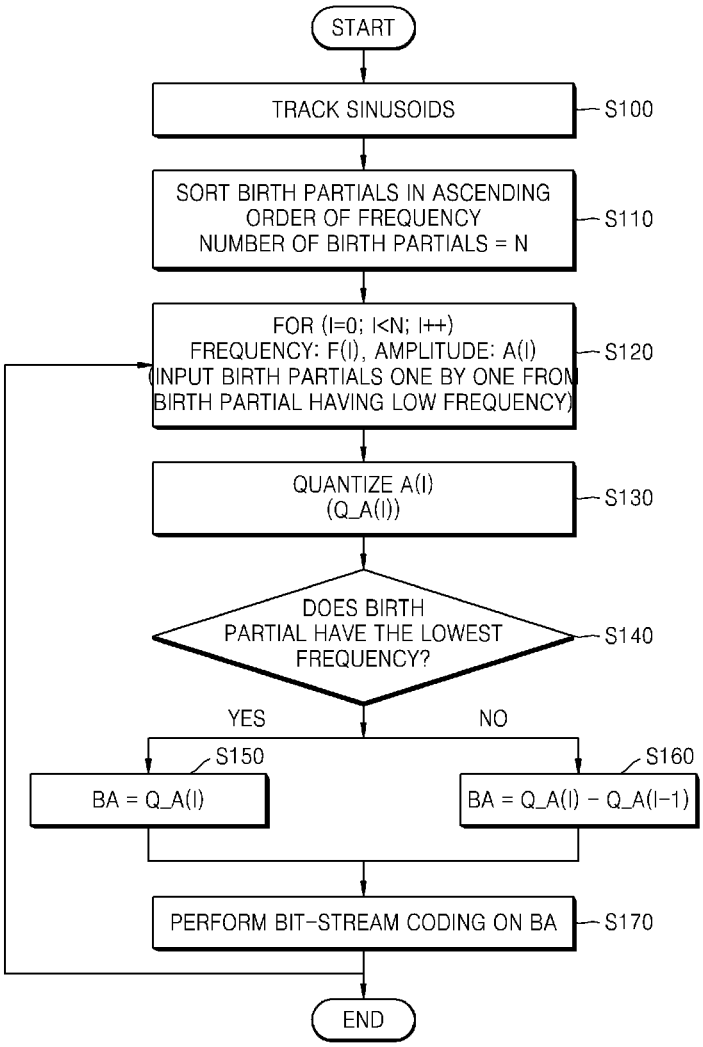
FIG. 2 (RELATED ART)
FIG. 2 is a flowchart of a related art audio coding method.
Figure 3:
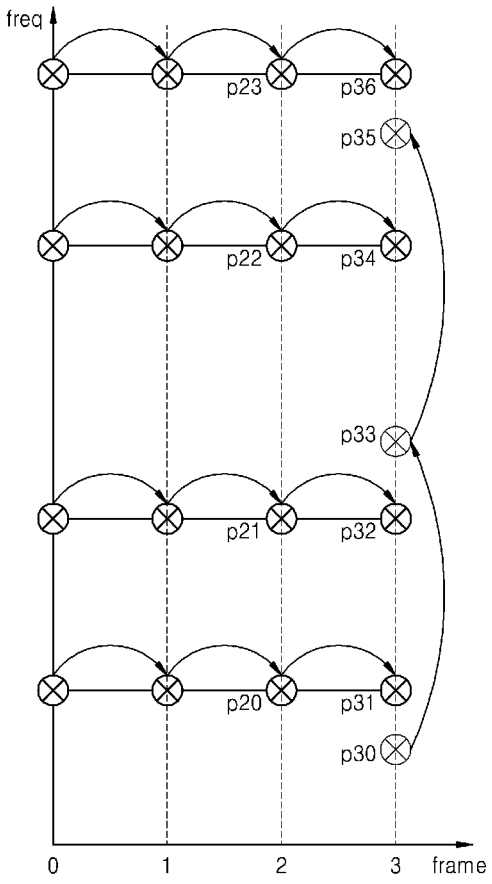
FIG. 3 (RELATED ART)
FIG. 3 is a graph of an example to which the audio coding method of FIG. 2 is applied.

In FIG. 3 according to a related art method, in order to code an amplitude a33 of the birth mode sinusoid p33, the birth mode sinusoid p30 having the nearest frequency to the birth mode sinusoid p33 is found from among the birth mode sinusoids p30, p33, and p35, and a difference diff33_related=a33−a30 is calculated and coded.

On the other hand, according to the current exemplary embodiment, the continuation mode sinusoid p32 having the nearest frequency to the birth mode sinusoid p33 is found from among all the sinusoids including the continuation mode sinusoids as well as the birth mode sinusoids and a difference diff33_present 10=a33−a32 is calculated and coded.

Due to a large frequency difference between the birth mode sinusoid p33 and the birth mode sinusoid p30, the difference diff33_related is large. On the other hand, due to a small frequency difference between the birth mode sinusoid p33 and the continuation mode sinusoid p32, the difference diff33_present 10 is small. As such, according to the present invention, the number of bits required to code an amplitude of a birth mode sinusoid is reduced.

Referring back to FIG. 5, the searching for the sinusoid having the closest frequency in operation S250 may be performed by using a variety of methods as described below.

1. A method of searching for a sinusoid having the closest frequency from among previously coded sinusoids of an immediate previous frame and a current frame.

2. A method of searching for a sinusoid having the closest frequency from among sinusoids previously coded and stored in a storage unit, that is, coded sinusoids of all previous frames and a current frame.

3. A method of searching for a sinusoid having the closest frequency from among all previously coded sinusoids except sinusoids of a current frame.

4. A method of searching for a sinusoid having the closest frequency from among previously coded sinusoids of a current frame.

5. A method of searching for a sinusoid having the closest frequency from among previously coded sinusoids of an immediate previous frame and a current frame, which have lower frequencies than the frequency of a birth mode sinusoid to be coded.

6. A method of searching for a sinusoid having the closest frequency from among sinusoids previously coded and stored in a storage unit, that is, coded sinusoids of all previous frames and a current frame, which have lower frequencies than the frequency of a birth mode sinusoid to be coded.

7. A method of searching for a sinusoid having the closest frequency from among all previously coded sinusoids except sinusoids of a current frame, which have lower frequencies than the frequency of a birth mode sinusoid to be coded.

8. A method of searching for a sinusoid having the closest frequency from among previously coded sinusoids of a current frame, which have lower frequencies than the frequency of a birth mode sinusoid to be coded.

Advantages obtained by using the sinusoids of the previous frame in addition to the sinusoids of the current frame will now be described with reference to FIG. 8.

Figure 8:
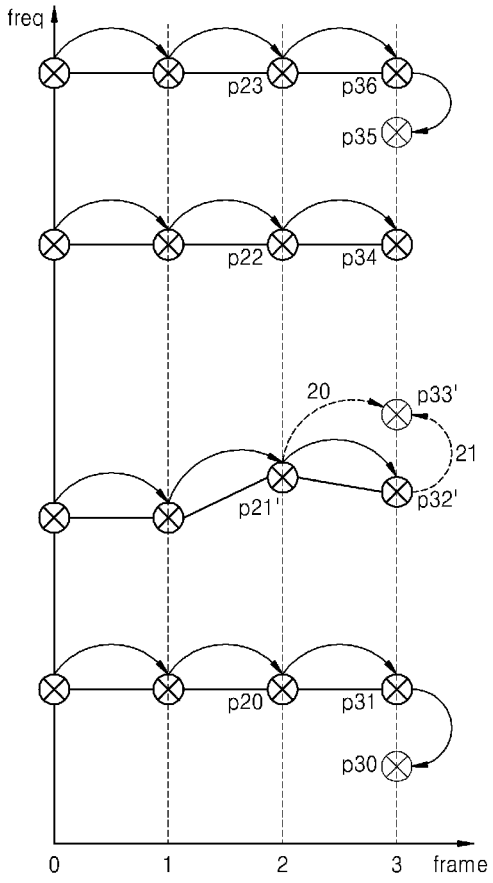
FIG. 8 is a graph of an example to which a sinusoidal audio coding method according to another exemplary embodiment of the present invention is applied.

FIG. 8 is a graph of an example to which a sinusoidal audio coding method according to another exemplary embodiment of the present invention is applied.

Referring to FIG. 8, assuming that a sinusoid p33' is coded, a sinusoid having the closest frequency in a current frame is a sinusoid p32'. However, the sinusoid having the closest frequency in a previous frame is a sinusoid p21'. Accordingly, if only sinusoids of the current frame are used, an amplitude of the sinusoid p33' is coded by using the sinusoid p32'. In this case, an amplitude difference is represented by a reference numeral 21. However, if sinusoids of the previous frame are also used, the amplitude of the sinusoid p33' is coded by using the sinusoid p21'. In this case, the amplitude difference is represented by a reference numeral 20.

Referring back to FIG. 5 the calculating and coding of the difference between the amplitude a(i) and the amplitude b(i) in operation S260 may be performed by using a variety of methods as described below.

1. A method of quantizing each of an amplitude a(i) of a sinusoid to be coded and an amplitude b(i) of a sinusoid having the closest frequency (the quantized amplitudes are respectively represented as qa and qb), and calculating and coding a difference between the quantized amplitudes (y=qa−qb). Here, a decoder has values corresponding to qb and y and thus qa=qb+y may be calculated.

2. A method of quantizing an amplitude b(i) of a sinusoid having the closest frequency (the quantized amplitude is represented as qb), calculating a difference between an amplitude a(i) of a sinusoid to be coded and the quantized amplitude qb (d=a(i)−qb), and quantizing and coding the difference d.

Here, a decoder may calculate the difference d by inverse quantizing the coded value, and may calculate the amplitude a(i) of the sinusoid from the difference d (a(i)=d+qb).

Coding efficiency of a sinusoidal audio coding method according to an exemplary embodiment of the present invention and the coding efficiency of a conventional sinusoidal audio coding method will now be compared to each other with reference to a result of a test.

FIG. 9 is a table showing coding gains obtained by a sinusoidal audio coding method according to an exemplary embodiment of the present invention in comparison to a related art sinusoidal audio coding method.

In FIG. 9, a coding gain is a reduction rate of the number of bits of coded data. For example, a coding gain of 15.89% means that the number of bits is reduced by 15.89%.

Referring to FIG. 9, the test is performed by using eight test sequences such as Bass, Brahms, Dongwoo, Dust, Harp, Horn, Hotel, and Trilogy.

Coding Gain of Amplitude of Birth Mode Sinusoid of the first column means a reduction rate of the number of bits used to code amplitudes of birth mode sinusoids. As shown in FIG. 9, an average coding gain of 15.89% is obtained in comparison to the conventional sinusoidal audio coding method.

Coding Gain of Birth Mode Sinusoid of the second column means a reduction rate of the number of bits used to code amplitudes, frequencies, and phases of birth mode sinusoids. As shown in FIG. 9, the number of bits used to code the entire birth mode sinusoids is reduced by 4.28% on average.

Coding Gain of Entire Bit Rate of the third column means a reduction rate of the number of bits used to code both birth mode sinusoids and continuation mode sinusoids. As shown in FIG. 9, the number of all coded bits is reduced by 2.11% on average in comparison to the related art sinusoidal audio coding method.

The exemplary embodiments of the present invention can also be embodied as computer readable code on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices.

As described above, according to the exemplary embodiments of the present invention, an amplitude of a birth mode sinusoid may be coded so that the coded amplitude has a low bit rate by searching for a sinusoid having the closest frequency to the birth mode sinusoid from among sinusoids including continuation mode sinusoids as well as birth mode sinusoids and calculating an amplitude difference between the birth mode sinusoid and the sinusoid having the closest frequency. Thus, efficient coding of an audio signal is enabled.

While the present invention has been particularly shown and described with reference to exemplary embodiments thereof, it will be understood by those of ordinary skill in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A method of sinusoidal audio coding, the method comprising:

extracting sinusoids of a current frame from an input audio signal;

tracking and coding a continuation mode sinusoid of the current frame by using a sinusoid of a previous frame which continues to the continuation mode sinusoid;

searching for a sinusoid having a closest frequency to a frequency of a birth mode sinusoid of the current frame, wherein the sinusoid having the closest frequency is searched among continuation mode sinusoids of the current frame and the previous frame, and birth mode sinusoids of the current frame;

calculating and coding a difference between an amplitude of the sinusoid having the closest frequency and an amplitude of the birth mode sinusoid; and coding the frequency of the birth mode sinusoid, wherein the birth mode sinusoid is generated in the current frame but not continued from the previous frame, and wherein the tracking and coding is performed by a sinusoidal tracking unit which is implemented as hardware.

2. The method of claim 1, wherein the sinusoid having the closest frequency is one of sinusoids having lower frequencies than the frequency of the birth mode sinusoid.

3. The method of claim 1, wherein the sinusoid having the closest frequency is one of previously coded sinusoids.

4. The method of claim 3, wherein the sinusoid having the closest frequency is a sinusoid of the current frame.

5. The method of claim 3, wherein the sinusoid having the closest frequency is not located in the current frame.

6. The method of claim 5, wherein the sinusoid having the closest frequency is a sinusoid of a frame immediately previous to the current frame.

7. The method of claim 1, wherein the calculating and coding the difference between the amplitude of the sinusoid having the closest frequency and the amplitude of the birth mode sinusoid comprises:

quantizing the amplitude of the sinusoid having the closest frequency;

inverse quantizing the quantized amplitude;

calculating a difference between the amplitude of the birth mode sinusoid and the inverse quantized amplitude;

quantizing the difference; and coding the quantized difference.

8. An apparatus for sinusoidal audio coding, the apparatus comprising:

a sinusoidal analysis unit that extracts sinusoids of a current frame from an input audio signal;

a sinusoid tracking unit that tracks and codes a continuation mode sinusoid of the current frame by using a sinusoid of a previous frame which continues to the continuation mode sinusoid;

a birth mode amplitude coding unit that searches for a sinusoid having a closest frequency to a frequency of a birth mode sinusoid of the current frame, and calculates and codes a difference between an amplitude of the sinusoid having the closest frequency and an amplitude of the birth mode sinusoid; and a birth mode frequency coding unit that codes the frequency of the birth mode sinusoid, wherein the birth mode sinusoid is generated in the current frame but not continued from the previous frame, wherein the sinusoid having the closest frequency is searched among continuation mode sinusoids of the current frame and the previous frame, and birth mode sinusoid of the current frame, and wherein the sinusoid tracking unit is implemented as hardware.

9. The apparatus of claim 8, wherein the sinusoid having the closest frequency is one of sinusoids having lower frequencies than the frequency of the birth mode sinusoid.

10. The apparatus of claim 8, wherein the sinusoid having the closest frequency is one of previously coded sinusoids.

11. The apparatus of claim 10, wherein the sinusoid having the closest frequency is a sinusoid of the current frame.

12. The apparatus of claim 10, wherein the sinusoid having the closest frequency is not located in the current frame.

13. The apparatus of claim 12, wherein the sinusoid having the closest frequency is a sinusoid of a frame immediately previous to the current frame.

14. The apparatus of claim 8, wherein the birth mode amplitude coding unit quantizes the amplitude of the sinusoid having the closest frequency, inverse quantizes the quantized amplitude, calculates a difference between the amplitude of the birth mode sinusoid and the inverse quantized amplitude, quantizes the difference, and codes the quantized difference.

15. A method of sinusoidal audio decoding, the method comprising:

decoding a continuation mode sinusoid from among coded sinusoids of a current frame of an audio signal;

decoding a frequency of a birth mode sinusoid of the current frame;

searching for a sinusoid having a closest frequency to the decoded frequency of the birth mode sinusoid, wherein the sinusoid having the closest frequency is searched among continuation mode sinusoids of the current frame and the previous frame, and birth mode sinusoids of the current frame;

decoding a coded amplitude difference of the birth mode sinusoid having the closest frequency; and calculating an amplitude of the birth mode sinusoid by adding an amplitude of the sinusoid having the closest frequency to the decoded amplitude difference, wherein the continuation mode sinusoid is a sinusoid that continues from a previous frame, and the birth mode sinusoid is a sinusoid that is generated in the current frame but not continued from the previous frame, and wherein the sinusoids are coded by a sinusoidal tracking unit which is implemented as hardware.

16. The method of claim 15, wherein the sinusoid having the closest frequency is one of sinusoids having lower frequencies than the frequency of the birth mode sinusoid.

17. The method of claim 15, wherein the sinusoid having the closest frequency is one of previously decoded sinusoids.

18. An apparatus for sinusoidal audio decoding, the apparatus comprising:

a continuation mode sinusoid decoding unit that decodes a continuation mode sinusoid from among coded sinusoids of a current frame of an audio signal;

a birth mode frequency decoding unit that decodes a frequency of a birth mode sinusoid of the current frame; and a birth mode amplitude decoding unit that searches for a sinusoid having a closest frequency to the decoded frequency of the birth mode sinusoid, decodes a coded amplitude difference of the birth mode sinusoid and the sinusoid having the closest frequency, and calculates an amplitude of the birth mode sinusoid by adding an amplitude of the sinusoid having the closest frequency to the decoded amplitude difference, wherein the sinusoid having the closest frequency is searched among continuation mode sinusoids of the current frame and the previous frame, and birth mode sinusoids of the current frame, wherein the continuation mode sinusoid is a sinusoid that continues from a previous frame, and the birth mode sinusoid is a sinusoid that is generated in the current frame but not continued from the previous frame, wherein the sinusoids are coded by a sinusoidal tracking unit which is implemented as hardware, and wherein the continuation mode sinusoid decoding unit is implemented as hardware.

19. The apparatus of claim 18, wherein the sinusoid having the closest frequency is one of sinusoids having lower frequencies than the frequency of the birth mode sinusoid.

20. The apparatus of claim 18, wherein the sinusoid having the closest frequency is one of previously decoded sinusoids.

21. A non-transitory computer readable recording medium having recorded thereon a computer program for executing a method of sinusoidal audio decoding, the method comprising:

decoding a continuation mode sinusoid from among coded sinusoids of a current frame of an audio signal;

decoding a frequency of a birth mode sinusoid of the current frame;

searching for a sinusoid having a closest frequency to the decoded frequency of the birth mode sinusoid decoding a coded amplitude difference of the birth mode sinusoid and the sinusoid having the closest frequency; and calculating an amplitude of the birth mode sinusoid by adding an amplitude of the sinusoid having the closest frequency to the decoded amplitude difference, wherein the sinusoid having the closest frequency is searched among continuation mode sinusoids of the current frame and the previous frame, and birth mode sinusoids of the current frame, wherein the continuation mode sinusoid is a sinusoid that continues from a previous frame, and the birth mode sinusoid is a sinusoid that is generated in the current frame but not continued from the previous frame.

* * * * *